US007845265B1

(12) United States Patent
Park et al.

(10) Patent No.: US 7,845,265 B1
(45) Date of Patent: Dec. 7, 2010

(54) NON-CERAMIC HARD ARMOR COMPOSITE

(75) Inventors: Andrew D. Park, Ashburn, VA (US); Dave Park, Glendora, CA (US); Alexander J. Park, Midlothian, VA (US); William B. Perciballi, Phoenix, AZ (US)

(73) Assignee: Armorworks Enterprises, LLC, Chandler, AZ (US)

( * ) Notice: Subject to any disclaimer, the term of this patent is extended or adjusted under 35 U.S.C. 154(b) by 0 days.

(21) Appl. No.: 12/657,640

(22) Filed: Jan. 25, 2010

Related U.S. Application Data

(63) Continuation of application No. 10/730,805, filed on Dec. 9, 2003, now abandoned.

(51) Int. Cl.
*F41H 5/02* (2006.01)

(52) U.S. Cl. ..... 89/36.02; 442/135

(58) Field of Classification Search ..... 442/134, 442/135, 149, 228, 232, 376, 378; 428/911; 89/36.01, 36.02, 36.05; 2/2.5
See application file for complete search history.

(56) References Cited

U.S. PATENT DOCUMENTS

| | | | | |
|---|---|---|---|---|
| 5,635,288 | A * | 6/1997 | Park | 428/105 |
| 6,408,733 | B1 | 6/2002 | Perciballi | |
| 6,562,435 | B1 | 5/2003 | Brillhart, III et al. | |
| 2001/0053645 | A1 | 12/2001 | Henderson | |
| 2003/0139108 | A1 * | 7/2003 | Klintworth et al. | 442/134 |
| 2004/0216595 | A1 * | 11/2004 | Dickson | 89/36.02 |
| 2005/0066805 | A1 | 3/2005 | Park et al. | |

OTHER PUBLICATIONS

High Performance "M5" Fiber for Ballistics/Structural Composites; US Army Soldier & Biological Chemical Command & Magellan Systems Int'l; Full Article; Publ prior to Sep. 17, 2003.

* cited by examiner

*Primary Examiner*—Arti Singh-Pandey
(74) *Attorney, Agent, or Firm*—Schwartz Law Firm, P.C.

(57) ABSTRACT

A hard armor composite includes a rigid non-ceramic facing and a ballistic fabric backing. The fabric backing is carried by the facing, and includes an array of bundled high-performance fibers. The fibers have a tensile strength greater than 7 grams per denier and a denier per filament ratio of less than 5.4.

14 Claims, 1 Drawing Sheet

NON-CERAMIC HARD ARMOR COMPOSITE

TECHNICAL FIELD AND BACKGROUND OF THE INVENTION

This invention relates to a hard armor composite, and more particularly to an improved small arms protection insert (SAPI) applicable for protecting against multiple small arms bullets and projectiles. In a preferred embodiment, the invention incorporates a rigid non-ceramic facing and a ballistic fabric backing.

Ceramic armor is typically used for body armor and for the outer coverings of different types of vehicles, such as various types of land vehicles, ships, and aircraft. Typically, ceramic tiles are adhesively secured to a substrate then encapsulated in an outer cover. The armor system is then attached to a vehicle by a variety of means or merely placed in a fabric pocket, as in the case of body armor. An inherent problem in the prior art is that ceramic armor is relatively heavy, and is configured for a fixed level of protection against a single ballistic threat.

The current SAPI incorporates ceramic and an extended chain polyethylene fiber base material known in the industry as "Spectra Unidirectional Cross Plied". This material contains fibers produced by Honeywell International, Inc., and distributed under the brand Spectra Shield® PCR and Spectra Shield® Plus PCR. The current SAPI has been accepted for application by the United States military. However, due to limited production and sources of Spectra Shield® PCR and Spectra Shield® Plus PCR, a need exists for an alternative acceptable ballistic fabric construction which can be readily obtained from multiple sources.

A further need exists for a reduced-weight SAPI which offers at least comparable and preferably increased ballistic performance. Military specifications call for a SAPI which meets predetermined maximum weight and performance criteria. The ballistic fabric used in the current SAPI has a denier per filament (dpf) ratio of 5.4—denier being defined as a weight measurement in grams per 9000 meter of fiber length; and denier per filament (dpf) defined as denier divided by the number of filaments in a fiber bundle. For an example, Spectra Shield® PCR comprises a nominal 1300 denier fiber with 240 filaments (or, 5.4 dpf). The present invention uses a lower dpf fiber which meets or exceeds the required ballistic performance criteria. The reduced fiber weight combined with a lighter, less costly non-ceramic facing forms a novel SAPI superior in regards to both weight and performance. The overall weight of the non-ceramic SAPI is well below that prescribed by United States military specifications. In addition, the non-ceramic SAPI is easily molded for enhanced curvature, and has improved field durability as compared to a ceramic SAPI. The ceramic SAPI is extremely hard and brittle, and difficult to shape.

SUMMARY OF INVENTION

Therefore, it is an object of the invention to provide a hard armor composite which incorporates a non-ceramic rigid facing and fabric backing including high performance, low denier-per-filament (dpf) fibers. The rigid facing and fabric backing are preferably separately formed and subsequently joined together to create the hard armor composite. Alternatively, the facing and backing may be integrally-formed together under heat and pressure in a single step process.

It is another object of the invention to provide a non-ceramic hard armor composite which offers substantial ballistic performance, is relatively lightweight, and easily molded for enhanced curvature.

It is another object of the invention to provide a non-ceramic hard armor composite which enables use of a less costly and lighter facing without sacrificing ballistic performance.

It is another object of the invention to provide a non-ceramic hard armor composite which provides protection against multiple types of ballistic projectiles including NATO 7.62×51 mm—80 Ball, Soviet 7.62 mm×54R Ball Type LPS, and U.S. 5.56 mm×M855 Ball.

It is another object of the invention to provide a non-ceramic hard armor composite which may be used alone or as a supplementary armor system to provide increased protection from ballistic projectiles.

It is another object of the invention to provide a non-ceramic small arms protection insert (SAPI) applicable for being worn by military and law enforcement personnel, and which has improved field durability as compared to a ceramic SAPI.

It is another object of the invention to provide a non-ceramic hard armor composite which, when placed in a body armor vest pocket, provides ballistic protection from 5.56 mm and 7.62 rounds.

It is another object of the invention to provide alternate, lighter, new and useful means of protecting against ballistic projectiles attack.

It is another object of the invention to provide a new and useful means of constructing a hard armor composite.

It is another object of the invention to provide a new and useful means of incorporating a composite armor backing with a non-ceramic facing.

These and other objects of the present invention are achieved in the preferred embodiments disclosed below by providing a hard armor composite including a rigid non-ceramic facing and a ballistic fabric backing. The fabric backing is carried by the facing, and includes an array of bundled high-performance fibers. The fibers have a tensile strength greater than 7 grams per denier and a denier per filament ratio of less than 5.4.

The term "carried by" means that the fabric backing is bonded or otherwise secured, either directly or indirectly, to the rigid facing. The term "non-ceramic facing" refers to a rigid facing constructed of less than 5% ceramic material, and more preferably, without a trace of ceramic material. Preferably, the entire hard armor composite is constructed without a trace of ceramic material.

According to another preferred embodiment of the invention, the fabric backing includes a plurality of overlying fabric layers. The fabric layers may be woven, non-woven, partially non-woven, or knitted. Alternatively, the layers may comprise unidirectional tape which is cross-plied in any angle, or three-dimensional woven or knitted fabrics.

According to another preferred embodiment of the invention, the fabric layers are laminated under heat and pressure to form a unitary ballistic structure.

According to another preferred embodiment of the invention, means are provided for adhering the fabric backing to the rigid facing.

Preferably, the means for adhering is an adhesive selected from the group including a thermoplastic polymer resin matrix and a thermosetting polymer resin matrix.

According to another preferred embodiment of the invention, the means for adhering is a polymer film.

According to another preferred embodiment of the invention, the means for adhering is an adhesive selected from the group including an epoxy adhesive, a polysulfide adhesive, a polyurethane adhesive, a phenolic adhesive, a polyester adhesive, a polyvinyl butyral adhesive, a polyolefin adhesive, and a vinyl ester adhesive.

According to another preferred embodiment of the invention, the rigid facing is constructed of a material selected from the group including steel, glass, aluminum, titanium, and graphite.

Preferably, the high-performance fibers are selected from the group including aramid, ultra-high molecular weight polyethylene (UHMWPE), poly {p-phenylene-2, 6-benzobisoxazole} (PBO), and poly {diimidazo pyridinylene (dihydroxy)phenylene} (M5).

Preferably, the high-performance fibers comprise one or a combination of the following commercial synthetic fibers: Twaron®, manufactured and distributed by Teijin Twaron® in Conyers, Ga.; Spectra Shield® PCR, manufactured and distributed by Honeywell International, Inc. of Colonial Heights, Va.; PBO Zylon®, manufactured and distributed by Toyobo, Japan; and M5.

Alternatively, the fabric backing may comprise multiple layers including one or a combination of Dyneema® UD75 HB2 unidirectional cross-plied material, manufactured and distributed by DSM of Greenville, N.C. and DSM of the Netherlands; and T-Flex™ unidirectional cross-plied material, manufactured and marketed by PTI Armor Systems of Glendora, Calif.

According to another preferred embodiment of the invention, the rigid facing includes a generally flat, continuous monolithic plate. The plate may also have a slight single, double, or compound curvature.

Preferably, the rigid facing and fabric backing have a combined thickness of less than 0.900-inches.

Preferably, the rigid facing and fabric backing have a combined weight of less than 5.1 pounds per square foot.

According to another preferred embodiment of the invention, the rigid facing is constructed of a non-ceramic material selected from the group including boron carbide, silicon carbide, titanium diboride, aluminum nitride, silicon nitride, sintered silicon carbide, sintered silicon nitride, and aluminum oxide.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
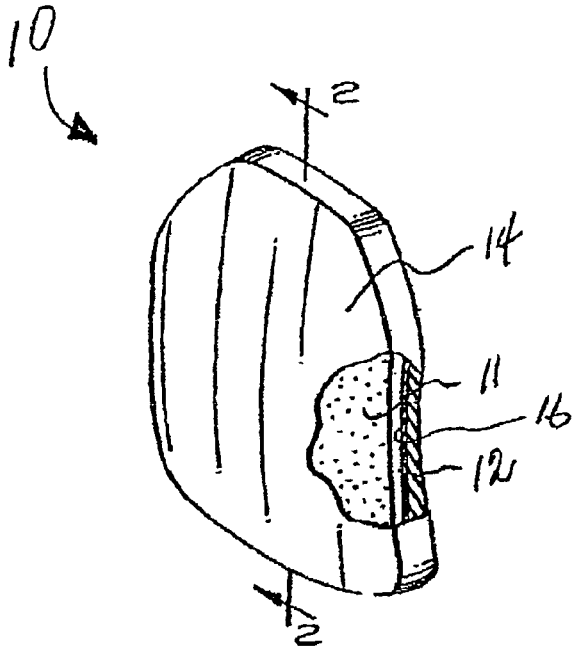
FIG. 1 is a perspective view of a non-ceramic hard armor composite according to one preferred embodiment of the present invention, and showing a portion of the outer cover torn away to expose the interior elements.

Referring now specifically to the drawings, a non-ceramic hard armor composite according to the present invention is illustrated in FIG. 1, and shown generally at reference numeral 10. In one application, the composite 10 is a small arms protection insert (SAPI) designed to protect against multiple small arms bullets and projectiles. The composite 10 is constructed according to United States military specifications, CO/PD 00-03D dated Jan. 13, 2003, in sizes X-small, small, medium, large, and X-large ranging in weight from 2.85 to 5.35 pounds. All SAPI sizes have a uniform nominal areal density of 5.1 pounds per square foot or less. The dimensional measurements are indicated in Drawing Nos. 2-6-265, 2-6-266, 2-6-267, 2-6-268, and 2-6-269 of CO/PD 00-03D. The entire subject matter of CO/PD 00-03D, including text, drawings, tables, and charts, is incorporated herein by reference.

Figure 2:
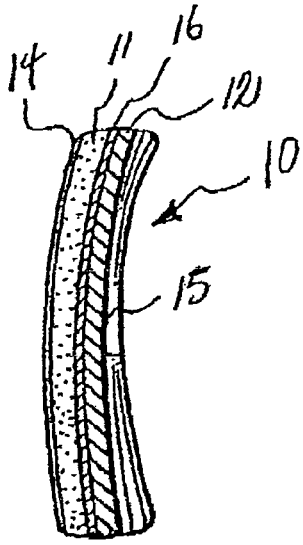
FIG. 2 is a cross-sectional view of the non-ceramic hard armor composite taken substantially along line 2-2 of FIG. 1.

As shown in FIGS. 1 and 2, the hard armor composite (SAPI) 10 comprises a rigid non-ceramic plate 11 and ballistic fabric backing 12 encased in an outer cover 14. The cover 14 may be formed of a single knit material, such as nylon fabric, or may be a rubberized coating formed by dipping, or may be a combination of fabric, rigid plastic, and foam or honeycomb structure that protects the plate from wear-and-tear, and which contains any fragmentation upon impact as appropriate. Preferably, the cover 14 includes a bake panel 15 that either partially or completely covers the rear surface of the composite 10.

The plate 11 comprises a rigid, non-ceramic facing defining a first level of hard armor protection in the composite SAPI. The rigid plate 11 may incorporate any of the above-mentioned high-performance, low dpf fibers combined with a number of individual non-ceramic elements, such as S-2 glass fiber, carbon fiber, silicone-carbide, and graphite, arranged in either woven layers, non-woven unidirectional layers, or knit layers, or three-dimensionally knit or woven structures. The resulting composite is either flat or molded to any desired rigid form. Although plate thickness may be varied to suit the specific SAPI need, the preferred structural arrangement ranges from 0.080-inches to 0.40-inches in thickness.

The fabric backing 12 is bonded or otherwise secured, either directly or indirectly, to the rigid plate 11, and provides a second level of protection against ballistic penetration. Preferably, the rigid plate 11 and fabric backing 12 are joined together by a layer 16 of adhesive, such as a thermoplastic or thermoset polymer, an elastomeric resin matrix, or a film, such as epoxy, polyurethane, polysulfide, polyolefin, phenolic, polyester, vinyl ester, polyvinyl butyral.

The backing 12 is constructed of bundled, high-performance, low denier per filament (dpf) fibers comprising any one or a combination of aramid, extended chain ultra-high molecular weight polyethylene (UHMWPE), poly {p-phenylene-2, 6-benzobisoxazole} (PBO), and poly {diimidazo pyridinylene (dihydroxy)phenylene} (M5). Each of these fibers has a tensile strength greater than 7 grams per denier. Suitable commercial fibers include: Twaron® micro-denier fiber of less than nominal 1000 denier and 1.5 dpf or lower; Spectra Shield® PCR fiber of less than nominal 1300 denier and less than 5.4 dpf; Dyneema® UD (unidirectional) fiber of nominal 1600 denier and 2.0 dpf or lower; PBO Zylon® fiber of nominal 1000 or 500 denier and 1.5 dpf or lower; and aramid Kevlar® fiber of nominal 1500 denier and 1.5 dpf. The fibers are preferably HM (high modulus) grade with low moisture content. The preferred embodiment utilizes high-performance fibers having less than 5.4 dpf, and more preferably, less than 2.0 dpf, and most preferably, less than 1.5 dpf. In addition to the above, the backing 12 may incorporate other non-ceramic elements, such as S-2 glass fiber, carbon fiber, silicone-carbide, and graphite.

The fibers are incorporated in multiple, stacked layers comprising knit, woven, or non-woven fabrics, non-woven or woven unidirectional tapes, felts, and three-dimensional structures. The stacked layers are laminated under heat and pressure together with any of a variety of polymer compounds to create a dense, rigid, unitary ballistic structure ranging in thickness from 0.130-inches to 0.350-inches. Lamination occurs via autoclave, press molding, a resin transfer mold, and/or an oven with vacuum pressure. According to one embodiment, the fabric backing 12 is further encased in a polymer matrix or film, specifically, a thermoplastic or thermoset matrix. The matrix may include any suitable polymer resin or film, such as phenolic, polysulfide, phenolic, polyvinyl butyral rubber blends, polyester, vinyl ester, polyurethane, and polyolefin resins or combinations thereof. When using a polymer resin matrix, the preferred resin content ranges from fifteen to twenty-four percent by weight.

Figure 3:
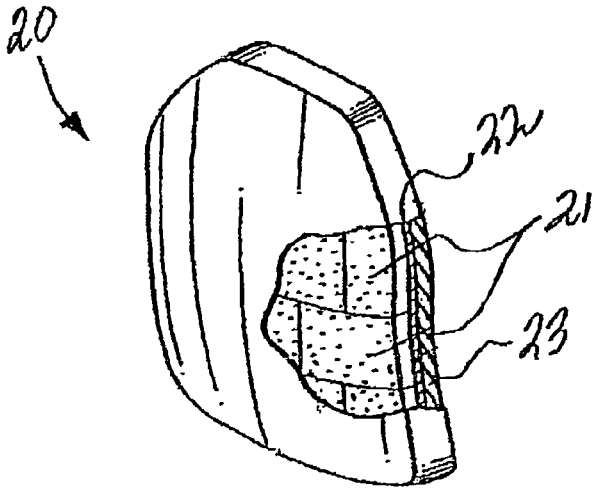
FIG. 3 is a perspective view of a non-ceramic hard armor composite according to a second preferred embodiment of the present invention, and showing a portion of the outer cover torn away.

In an alternate embodiment shown in FIG. 3, the hard armor composite (SAPI) 20 includes an arrangement of individual non-ceramic tiles 21 defining a rigid facing, an adhesive layer 22, and a ballistic fabric backing 23. The tiles 21 can be square or otherwise shaped to suit the dimensional needs of a particular application. The tiles 21 may be formed of steel, glass, aluminum, titanium, graphite, or other suitable non-ceramic material. The fabric backing 23 incorporates high-performance, low dpf fibers, and is constructed in a manner identical to that described above. The adhesive layer 22 joins the tile elements and fabric backing together to form a unitary ballistic composite.

In each of the above embodiments, the hard armor composite 10, 20 forms a SAPI which meets or exceeds the ballistic performance criteria outlined in CO/PD 00-03D. Specifically, Section 3.9.3 of CO/PD 00-03D states that the SAPI when inserted in a nylon cordura carrier will be capable of defeating three impacts (2 impacts at 0-degrees obliquity and 1 impact at 30-degrees obliquity) from each of the following threats:

a. NATO 7.62×51 mm—80 Ball at 2,750+50 feet per second.

b. Soviet 7.62 mm×54R Ball Type LPS at 2,300+50 feet per second.

c. U.S. 5.56 mm M855 Ball at 3,250+50 feet per second.

The use of a ballistic fabric backing incorporating high-performance, low dpf fibers not only reduces the overall weight of the composite, but offers increased ballistic performance as compared relatively high dpf fibers. The current commercial SAPI incorporates high-performance fibers with a 5.4 dpf. The V50 ballistic performance of fabric constructed of this fiber is compared in the table below with fabric of lower dpf fibers.

V50 data with 9 mm 124 grams per Mil-STD 662.

| | Dpf | V50(fps) | ADT (Areal density) psf |
|---|---|---|---|
| UHMWPE fiber based fabric: | | | |
| Spectra Shield ® | 5.4 | 1590 | .91 |
| Dyneema ® UD | 2.0 | 1679 | .91 |
| Aramid fiber based fabric: | | | |
| Kevlar ® 29 | 1.5 | 1290 | .80 |
| Kevlar ® 29 | 1.5 | 1400 | 1.0 |
| Twaron ® | 1.0 | 1483 | .87 |
| Twaron ® | 1.0 | 1562 | .91 |
| T-Flex ™ | 1.0 | 1520 | .80 |
| T-Flex ™ | 1.0 | 1590 | .93 |

A non-ceramic hard armor composite is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

We claim:

1. A hard armor composite, comprising:

(a) a rigid non-ceramic facing comprising high-performance fibers having a tensile strength greater than 7 grams per denier and at least one non-ceramic element selected from a group consisting of glass fiber, carbon fiber, and graphite; and said high-performance fibers and said non-ceramic element being arranged in a structure selected from a group consisting of woven layers, non-woven unidirectional layers, knit layers, a three-dimensionally knit structure, and a three-dimensionally woven structure;

(b) a ballistic fabric backing carried by said facing, and comprising an array of bundled high-performance fibers, said fibers having a tensile strength greater than 7 grams per denier and a denier per filament ratio of less than 5.4; and (c) said rigid facing and fabric backing having a combined thickness of less than 0.900-inches, and a uniform areal density of no more than 5.1 pounds per square foot.

2. A hard armor composite according to claim 1, wherein said fabric backing comprises a plurality of overlying fabric layers.

3. A hard armor composite according to claim 2, wherein said fabric layers are laminated under heat and pressure to form a unitary ballistic structure.

4. A hard armor composite according to claim 1, and comprising means for adhering said fabric backing to said facing.

5. A hard armor composite according to claim 4, wherein said means for adhering comprises an adhesive selected from the group consisting of a thermoplastic polymer resin matrix and a thermosetting polymer resin matrix.

6. A hard armor composite according to claim 4, wherein said means for adhering comprises a polymer film.

7. A hard armor composite according to claim 4, wherein said means for adhering comprises an adhesive selected from the group consisting of an epoxy adhesive, a polysulfide adhesive, a polyurethane adhesive, a phenolic adhesive, a polyester adhesive, a polyvinyl butyral adhesive, a polyolefin adhesive, and a vinyl ester adhesive.

8. A hard armor composite according to claim 1, wherein said high-performance fibers are selected from the group consisting of aramid, ultra-high molecular weight polyethylene (UHMWPE), poly {p-phenylene-2, 6-benzobisoxazole} (PBO), and poly {diimidazo pyridinylene (dihydroxy)phenylene} (M5).

9. A hard armor composite according to claim 1, wherein said rigid facing comprising a generally flat, continuous monolithic plate.

10. A hard armor composite, comprising:

(a) a rigid non-ceramic facing comprising high-performance fibers having a tensile strength greater than 7 grams per denier and at least one non-ceramic element selected from a group consisting of glass fiber, carbon fiber, and graphite; and said high-performance fibers and said non-ceramic element being arranged in a structure selected from a group consisting of woven layers, non-woven unidirectional layers, knit layers, a three-dimensionally knit structure, and a three-dimensionally woven structure;

(b) a ballistic fabric backing carried by said facing, and comprising an array of bundled high-performance fibers, said fibers having a tensile strength greater than 7 grams per denier and a denier per filament ratio of no more than 2.0; and (c) said rigid facing and fabric backing having a combined thickness of less than 0.900-inches, and a uniform areal density of no more than 5.1 pounds per square foot.

11. A hard armor composite according to claim 10, and comprising means for adhering said fabric backing to said non-ceramic facing.

12. A hard armor composite according to claim 11, wherein said means for adhering comprises an adhesive selected from the group consisting of an epoxy adhesive, a polysulfide adhesive, a polyurethane adhesive, a phenolic adhesive, a polyester adhesive, a polyvinyl butyral adhesive, or a polyolefin adhesive, and a vinyl ester adhesive.

13. A hard armor composite according to claim 10, wherein said non-ceramic facing comprises a generally flat, continuous monolithic plate.

14. A hard armor composite according to claim 10, wherein said high-performance fibers are selected from the group consisting of aramid, ultra-high molecular weight polyethylene (UHMWPE), poly {p-phenylene-2,6-benzobisoxazole} (PBO), and poly {diimidazo pyridinylene (dihydroxy)phenylene} (M5).

* * * * *